United States Patent [19]

Huhta et al.

[11] Patent Number: 4,582,106

[45] Date of Patent: Apr. 15, 1986

[54] APPARATUS FOR SEPARATION OF BARK FROM TIMBER

[75] Inventors: Pentti Huhta, Salpakangas; Arvi Syrjanen, Lahti, both of Finland

[73] Assignee: Kone Oy, Helsinki, Finland

[21] Appl. No.: 683,637

[22] Filed: Dec. 19, 1984

[30] Foreign Application Priority Data

Dec. 30, 1983 [FI] Finland ..... 834897

[51] Int. Cl.[4] ..... B27L 1/00

[52] U.S. Cl. ..... 144/208 D; 144/208 R; 144/340

[58] Field of Search ..... 144/340, 208 R, 208 D, 144/208 F, 208 H

[56] References Cited

U.S. PATENT DOCUMENTS

| | | | |
|---|---|---|---|
| 1,087,959 | 2/1914 | Lisherness et al. | 144/208 D |
| 2,501,848 | 3/1950 | Johnson | 144/208 D |
| 2,576,861 | 11/1951 | Shaw | 144/208 F |
| 2,695,194 | 11/1954 | Hartwig | 144/208 D |
| 2,822,837 | 2/1958 | Clausen | 144/208 F |
| 3,016,074 | 1/1962 | Baker et al. | 144/208 F |

FOREIGN PATENT DOCUMENTS

| | | | |
|---|---|---|---|
| 33798 | 10/1964 | Finland | 144/208 F |

*Primary Examiner*—W. D. Bray
*Attorney, Agent, or Firm*—Bell & Arkin

[57] ABSTRACT

An apparatus for separating bark, such as birchbark, from timber during conveyance of the timber has a conveyor for advancing logs leaving a stripping drum. To achieve an effective separation of bark, rollers conveying the logs form a bark separating unit, where successive ones of the rollers are arranged at two levels, the rollers at the upper level being provided with spikes for scraping or detaching the bark, and the rollers on the lower level being substantially smooth-surfaced.

6 Claims, 2 Drawing Figures

APPARATUS FOR SEPARATION OF BARK FROM TIMBER

FIELD OF THE INVENTION

The present invention relates to an apparatus for separating bark, e.g. birchbark, from timber during conveyance of the timber, in which logs leaving a stripping drum move along a conveyor.

BACKGROUND OF THE INVENTION

In general, it is important that birchbark should be separated from the timber to be chipped, because the quality of the cellulose produced from the chippings is considerably improved if the proportion of birchbark in them can be kept low.

The simplest method employed for the separation of birchbark is the use of gravity alone, whereby loose bark falls through apertures between conveyor rollers. This procedure, however, has the disadvantage that only the very smallest and completely detached pieces of bark can fall through the gaps between the conveyor rollers, whereas large and partially detached pieces are carried along with the timber into the pulp cooking process and cause a deterioration of the quality of the product.

Another prior art device employs combining plates of a predetermined shape between the conveyor rollers. However, these solutions have proved unsatisfactory in practice. Therefore, there exists need for a new and practicable apparatus for this purpose.

SUMMARY AND OBJECTS OF THE INVENTION

It is accordingly an object of the present invention to at least partly mitigate these deficiencies and to provide a novel and improved, simple, reliable and efficient apparatus for the separation of bark from timber.

According to the present invention, there is provided apparatus for separating bark from timber during conveyance of the timber, the apparatus comprising, conveyor means for advancing the timber along a path of travel from a stripping drum, a bark separating unit included in the conveyor means, the bark separating unit comprising a plurality of pairs of rollers arranged in succession along and extending traversely of the path of travel, each of the pairs of rollers comprising a first roller and a second roller located beyond the first roller in the direction of travel of the timber, the first roller being arranged at a higher level than the second roller, each of the first rollers being provided with means for removing bark from the timber, and each of the second rollers having a substantially smooth peripheral surface.

The apparatus according to the present invention offers the advantage that, due to the two-level arrangement of the first and second rollers, a good bark separating performance is achieved.

In an advantageous embodiment of the invention each of the second rollers is located closer to its respective first roller than to the next succeeding one of the first rollers in the direction of travel of the timber.

Such an arrangement offers the advantage that a sufficient clearance is provided between each pair of rollers and the next pair of rollers for the bark, which moves forward under a thrust exerted thereon by the upper, first rollers to fall downwardly into a bark removal trough beneath the rollers. Correspondingly, the smaller clearances between the rollers of each pair help to prevent any pieces of bark entangled round the rollers from going back up onto the rollers.

The preferred embodiment of the invention comprises means for rotationally driving the first rollers at a first speed of rotation and means for rotationally driving the second rollers at a second speed of rotation which is slower than the first speed of rotation. This difference in the roller speeds offers the advantage that bark already moving down past the lower second rollers is not subjected to renewed thrust which might result in the bark being returned into the path of travel of the timber. Halving the rotational velocity offers the advantage that the differentiation is easy to implement.

This embodiment of the invention also comprises means for discharging at least one spray of water downwardly onto the timber on the first and second rollers from a location above the bark separating unit. When the timber is sprayed with water, an improvement is achieved in the bark separation performance as compared to dry separation.

BRIEF DESCRIPTION OF THE DRAWING

Further features, objects and advantages of the present invention will be more readily appeciated upon consideration of the following description of a preferred embodiment of the invention when taken in conjunction with the accompanying drawings wherein.

DESCRIPTION OF THE PREFERRED EMBODIMENT

Figure 1:
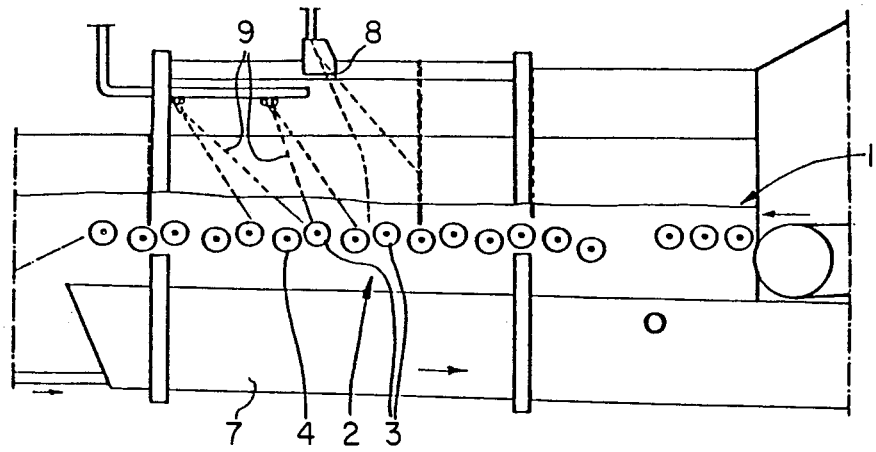
FIG. 1 presents an elevational view of a roller conveyor incorporating a bark separating apparatus according to the present invention.

In FIG. 1, there is illustrated a bark separating unit 2, which is located between a barking drum (not shown) and a chipping machine (not shown) on a roller conveyor line 1. Other important components of the bark separating unit on the roller conveyor line are a circulating-water spray nozzle 8, pressurized spray nozzles 9 and a bark removal trough 7.

Figure 2:
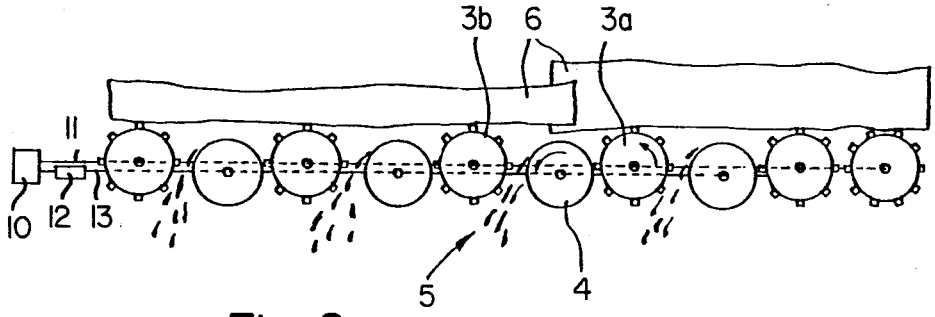
FIG. 2 illustrates parts of the bark separating apparatus of FIG. 1 in magnified elevational view.

In FIG. 2, reference numeral 6 indicates two logs on tree trunks which, while moving in a direction indicated by the arrow, carry plenty of loose bark on them, which has to be removed as completely as possible before the logs enter the chipping stage, since as described hereinbefore the quality of the cellulose to be produced from the chippings will deterioriate if the raw material contains birchbark. The bark separating unit comprises conveyor rollers extending transversely of the path of travel of the logs 6 and spaced apart in succession along such path.

These rollers comprise pairs of rollers, of which each pair comprises a first roller 3 provided on its periphery with outwardly projecting spikes for removing bark from the logs 6 on rotation of the first roller 3 relative to the logs 6, and a second roller 4 which is provided with a substantially smooth peripheral surface and which is located beyond the first roller 3 in the direction of travel of the logs 6.

As can be seen from the drawings, each first roller 3 is located at a level which is higher than its respective smooth-surfaced second roller 4.

Also, the rollers 3 and 4 are differently spaced apart in the horizontal direction so that each second roller 4 is horizontally closer to its respective first roller 3 than to the roller 3 which is the next succeeding roller in this direction of travel of the logs 6, i.e. the rollers of each pair of rollers 3 and 4 are horizontally closer to one another than to the preceding and succeeding pairs of rollers. In this manner, the pair of spiked first rollers 3 and the smooth-surfaced second rollers 4 are spaced so as to leave a clearance between these roller pairs which is sufficient to permit the bark 5 to fall down into the exit trough 7. In contrast, the clearance between each first roller 3 and its respective second roller 4 is so small that e.g. bark tending to roll up around the roller 4 is prevented from going back up onto the rollers.

An improved bark separation performance is achieved by having the upper, first rollers 3 rotate faster than the lower, second rollers 4. Under these conditions, each spiked first roller 3, rotating at a higher speed, precipitates the bark onto the respective lower second roller 4, while the latter, rotating more slowly, does not sling the bark further but lets it fall down.

For this purpose, a drive mechanism provided with a speed reduction device is provided for rotationally driving the rollers 3 and 4 at different speeds.

More particularly, a prime mover in the form of an electric motor 10 drives the first rollers 3 at a predetermined first speed through a belt and pulley drive transmission indicated diagrammatically by line 11 in FIG. 2. The electric motor 10 also rotationally drives the second rollers 4, through a speed reduction device 12 and a belt and pulley drive transmission 13, at a second speed which is slower than the first speed and which is suitably one half of the first speed.

The bark separation performance of the apparatus can be further improved by spraying water onto the logs 6. The apparatus is therefore provided with spraying equipment consisting of a circulating-water section 8, operated at the water pressure of a supply main, and of a pressurized spraying section 9, operated on a somewhat higher pressure. The purpose of this spraying equipment is to create a water curtain to prevent loose bark from being carried along on top of the logs. The pieces of bark are swept by the water jets down onto the bark separating rollers.

It will be obvious to a person skilled in the art that the invention is not exclusively confined to the example presented in the foregoing and that the present invention may instead be varied within the scope of the accompanying claims. For instance, the bark separation performance can be further improved by subjecting the timber stream on the conveyor to alternate spreading and converging movements to permit the loose bark on top of the logs to fall down more readily.

Thus, the foregoing description of the preferred embodiment of the invention has been presented for purposes of illustration and description, and is not intended to be exhaustive or to limit the invention to the precise form disclosed, since many obvious modifications and variations are possible in light of the above teaching. The embodiment was chosen and described in order best to explain the principles of the invention and its practical application, thereby to enable others skilled in the art best to utilize the invention in various embodiments and with various modifications as are suited to the particular use contemplated. It is intended that the scope of the invention be defined by the claims appended hereto, when interpreted in accordance with the full breadth to which they are fairly and legally entitled.

We claim:

1. Apparatus for separating bark from timber during conveyance of the timber, said apparatus comprising:

conveyor means for advancing said timber along a path of travel from a stripping drum; and a bark separating unit included in said conveyor means;

said bark separating unit comprising:

a plurality of pairs of rollers located in succession along and below the path of travel and extending transversely of the path of travel;

each of said pairs of rollers comprising a first roller and a second roller located beyond said first roller in the direction of travel of the timber;

said first roller extending upwardly further than said second roller;

each of said first rollers being provided at its periphery with means for removing bark from the timber; and each of said second rollers having a substantially smooth peripheral surface.

2. Apparatus as set forth in claim 1, wherein each of said second rollers is located closer to its respective first roller than to the next succeeding one of said first rollers in the direction of travel of said timber.

3. Apparatus as claimed in claim 1, further comprising means for rotationally driving said first rollers at a first speed of rotation and means for rotationally driving said second rollers at a second speed of rotation which is slower than said first speed of rotation.

4. Apparatus as claimed in claim 1, further comprising means for discharging at least one spray of water downwardly onto said timber on said first and second rollers from a location above said bark separating unit.

5. Apparatus for separating bark from timber during conveyance of the timber, said apparatus comprising:

conveyor means for advancing said timber along a path of travel from a stripping drum; and a bark separating unit included in said conveyor means;

said bark separating unit comprising:

a plurality of pairs of rollers located in succession along and below the path of travel and extending tranversely of the path of travel;

each of said pairs of rollers comprising a first roller and a second roller located beyond said first roller in the direction of travel of the timber;

said rollers of each pair being located horizontally closer to one another than to preceding and succeeding pairs of said rollers;

said first roller of each pair extending upwardly further than said second roller of the respective pair;

each of said first rollers being provided at its periphery with means for removing bark from the timber; and each of said second rollers having a substantially smooth peripheral surface; and means for rotationally driving said first rollers at a first speed of rotation and means for rotationally driving said second rollers at a second speed of rotation which is slower than said first speed of rotation.

6. Apparatus as claimed in claim 5, further comprising means for discharging at least one spray of water downwardly onto said timber on said first and second rollers from a location above said bark separating unit.

* * * * *